US009091077B2

(12) United States Patent
Boo

(10) Patent No.: US 9,091,077 B2
(45) Date of Patent: Jul. 28, 2015

(54) BUILDING PANEL WITH A MECHANICAL LOCKING SYSTEM

(71) Applicant: Välinge Innovation AB, Viken (SE)

(72) Inventor: Christian Boo, Kagerod (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

(21) Appl. No.: 14/612,881

(22) Filed: Feb. 3, 2015

(65) Prior Publication Data

US 2015/0152644 A1 Jun. 4, 2015

Related U.S. Application Data

(63) Continuation of application No. 14/074,273, filed on Nov. 7, 2013, now Pat. No. 8,973,331, which is a continuation of application No. 13/855,966, filed on Apr. 3, 2013, now Pat. No. 8,596,013.

(60) Provisional application No. 61/620,233, filed on Apr. 4, 2012.

(51) Int. Cl.

| | |
|---|---|
| ***E04F 15/12*** | (2006.01) |
| ***E04F 13/076*** | (2006.01) |
| ***E04B 1/61*** | (2006.01) |
| ***E04F 13/08*** | (2006.01) |

(52) U.S. Cl.

CPC ..... *E04F 13/076* (2013.01); *E04B 1/54* (2013.01); *E04F 13/0894* (2013.01); *E04F 2201/0138* (2013.01); *E04F 2201/023* (2013.01); *E04F 2201/042* (2013.01); *E04F 2201/044* (2013.01)

(58) Field of Classification Search

CPC ..... E04F 15/02038; E04F 15/02005; E04F 15/02; E04F 2201/0115; E04F 2201/0107; E04F 2201/0146; E04F 2201/0138; E04F 2201/0161; E04F 2201/0153; E04F 2201/041

See application file for complete search history.

(56) References Cited

U.S. PATENT DOCUMENTS 1,743,492 A * 1/1930 Sipe ..... 403/297
1,809,393 A * 6/1931 Rockwell ..... 52/99

(Continued)

FOREIGN PATENT DOCUMENTS

DE 10 2009 048 050 B3 1/2011
DE 10 2010 012 572 B3 7/2011

(Continued)

OTHER PUBLICATIONS

International Search Report issued in PCT/SE2013/050367, mailed Jun. 24, 2013, Patent-och registreringsverket, Stockholm, SE, 6 pages.

*Primary Examiner* — Christine T Cajilig
(74) *Attorney, Agent, or Firm* — Buchanan Ingersoll & Rooney P.C.

(57) ABSTRACT

Building panels 1, 1' provided with a mechanical locking system including a tongue 30, at an edge of a first panel 1, cooperating with a tongue groove 20, at an edge of an adjacent second panel 1', for vertical locking of the building panels. The edge of the first panel is provided with a displacement groove 60, which is downwardly open, and includes an inner wall 61, an outer wall 62, and an upper wall 67. The tongue 30 is formed out of the edge of the first panel. A resilient and displaceable and part 66 of the tongue 30 is displaceable into the displacement groove 60.

17 Claims, 12 Drawing Sheets

(56) References Cited

U.S. PATENT DOCUMENTS 1,902,716 A * 3/1933 Newton ..... 52/586.2
2,026,511 A * 12/1935 Storm ..... 52/443
2,204,675 A * 6/1940 Grunert ..... 52/578
2,277,758 A * 3/1942 Hawkins ..... 52/98
2,430,200 A * 11/1947 Wilson ..... 52/588.1
2,497,837 A * 2/1950 Nelson ..... 52/181
2,596,280 A * 5/1952 Nystrom ..... 52/578
2,732,706 A * 1/1956 Friedman ..... 52/586.1
2,740,167 A * 4/1956 Rowley ..... 52/591.1
2,863,185 A * 12/1958 Riedi ..... 403/297
2,865,058 A * 12/1958 Andersson et al. ..... 52/508
2,872,712 A * 2/1959 Brown et al. ..... 52/578
2,889,016 A * 6/1959 Warren ..... 52/98
3,023,681 A * 3/1962 Worson ..... 404/49
3,077,703 A * 2/1963 Bergstrom ..... 52/396.04
3,099,110 A * 7/1963 Spaight ..... 52/396.09
3,147,522 A * 9/1964 Schumm ..... 24/16 PB
3,271,787 A * 9/1966 Clary ..... 52/716.2
3,325,585 A * 6/1967 Brenneman ..... 52/288.1
3,378,958 A * 4/1968 Parks et al. ..... 49/489.1
3,396,640 A * 8/1968 Fujihara ..... 404/67
3,512,324 A * 5/1970 Reed ..... 52/588.1
3,517,927 A * 6/1970 Kennel ..... 482/128
3,526,071 A * 9/1970 Watanabe ..... 52/396.06
3,535,844 A * 10/1970 Glaros ..... 52/592.1
3,572,224 A * 3/1971 Perry ..... 404/40
3,579,941 A * 5/1971 Tibbals ..... 52/384
3,720,027 A * 3/1973 Christensen ..... 52/309.8
3,722,379 A * 3/1973 Koester ..... 404/68
3,742,669 A * 7/1973 Mansfeld ..... 52/396.07
3,760,547 A * 9/1973 Brenneman ..... 52/586.1
3,760,548 A * 9/1973 Sauer et al. ..... 52/592.1
3,778,954 A * 12/1973 Meserole ..... 52/747.1
3,849,235 A * 11/1974 Gwynne ..... 428/192
3,919,820 A * 11/1975 Green ..... 52/396.04
3,950,915 A * 4/1976 Cole ..... 52/586.2
4,030,852 A * 6/1977 Hein ..... 404/66
4,064,571 A * 12/1977 Phipps ..... 52/716.2
4,080,086 A * 3/1978 Watson ..... 404/69
4,082,129 A * 4/1978 Morelock ..... 144/368
4,100,710 A * 7/1978 Kowallik ..... 52/309.9
4,107,892 A * 8/1978 Bellem ..... 52/396.04
4,113,399 A * 9/1978 Hansen, Sr. ..... 403/329
4,169,688 A * 10/1979 Toshio ..... 404/40
4,196,554 A * 4/1980 Anderson et al. ..... 52/394
4,227,430 A * 10/1980 Jansson et al. ..... 81/177.4
4,299,070 A * 11/1981 Oltmanns et al. ..... 52/309.11
4,304,083 A * 12/1981 Anderson ..... 52/509
4,426,820 A * 1/1984 Terbrack et al. ..... 52/590.1
4,447,172 A * 5/1984 Galbreath ..... 404/68
4,512,131 A * 4/1985 Laramore ..... 52/586.1
4,599,841 A * 7/1986 Haid ..... 52/396.04
4,648,165 A * 3/1987 Whitehorne ..... 29/225
5,007,222 A * 4/1991 Raymond ..... 52/586.1
5,071,282 A * 12/1991 Brown ..... 404/68
5,148,850 A * 9/1992 Urbanick ..... 160/231.1
5,173,012 A * 12/1992 Ortwein et al. ..... 405/302.5
5,182,892 A * 2/1993 Chase ..... 52/539
5,247,773 A * 9/1993 Weir ..... 52/592.3
5,272,850 A * 12/1993 Mysliwiec et al. ..... 52/582.2
5,344,700 A * 9/1994 McGath et al. ..... 428/304.4
5,348,778 A * 9/1994 Knipp et al. ..... 428/35.8
5,465,546 A * 11/1995 Buse ..... 52/480
5,485,702 A * 1/1996 Sholton ..... 52/308
5,548,937 A * 8/1996 Shimonohara ..... 52/586.1
5,598,682 A * 2/1997 Haughian ..... 52/745.21
5,618,602 A * 4/1997 Nelson ..... 428/60
5,634,309 A * 6/1997 Polen ..... 52/392
5,658,086 A * 8/1997 Brokaw et al. ..... 403/327
5,671,575 A * 9/1997 Wu ..... 52/403.1
5,694,730 A * 12/1997 Del Rincon et al. ..... 52/586.1
5,755,068 A * 5/1998 Ormiston ..... 52/314
5,899,038 A * 5/1999 Stroppiana ..... 52/403.1
5,950,389 A * 9/1999 Porter ..... 52/586.1
5,970,675 A * 10/1999 Schray ..... 52/582.1
6,006,486 A * 12/1999 Moriau et al. ..... 52/589.1
6,029,416 A * 2/2000 Andersson ..... 52/592.1
6,052,960 A * 4/2000 Yonemura ..... 52/393
6,065,262 A * 5/2000 Motta ..... 52/582.1
6,173,548 B1 * 1/2001 Hamar et al. ..... 52/582.1
6,182,410 B1 * 2/2001 Pervan ..... 52/403.1
6,216,409 B1 * 4/2001 Roy et al. ..... 52/589.1
6,314,701 B1 * 11/2001 Meyerson ..... 52/588.1
6,363,677 B1 * 4/2002 Chen et al. ..... 52/586.1
6,385,936 B1 * 5/2002 Schneider ..... 52/589.1
6,418,683 B1 * 7/2002 Martensson et al. ..... 52/282.1
6,446,413 B1 * 9/2002 Gruber ..... 52/747.11
6,449,918 B1 * 9/2002 Nelson ..... 52/582.1
6,505,452 B1 * 1/2003 Hannig et al. ..... 52/582.1
6,553,724 B1 * 4/2003 Bigler ..... 52/36.1
6,591,568 B1 * 7/2003 Pålsson ..... 52/592.2
6,601,359 B2 * 8/2003 Olofsson ..... 52/588.1
6,617,009 B1 * 9/2003 Chen et al. ..... 428/195.1
6,647,689 B2 * 11/2003 Pletzer et al. ..... 52/592.1
6,647,690 B1 * 11/2003 Martensson ..... 52/601
6,651,400 B1 * 11/2003 Murphy ..... 52/586.2
6,670,019 B2 * 12/2003 Andersson ..... 428/90
6,685,391 B1 * 2/2004 Gideon ..... 405/16
6,763,643 B1 * 7/2004 Mårtensson ..... 52/586.1
6,766,622 B1 * 7/2004 Thiers ..... 52/591.3
6,769,219 B2 * 8/2004 Schwitte et al. ..... 52/592.1
6,769,835 B2 * 8/2004 Stridsman ..... 404/41
6,804,926 B1 * 10/2004 Eisermann ..... 52/592.1
6,862,857 B2 * 3/2005 Tychsen ..... 52/582.1
6,865,855 B2 * 3/2005 Knauseder ..... 52/592.1
6,874,291 B1 * 4/2005 Weber ..... 52/586.1
6,948,716 B2 * 9/2005 Drouin ..... 277/606
7,021,019 B2 * 4/2006 Knauseder ..... 52/588.1
7,051,486 B2 * 5/2006 Pervan ..... 52/586.1
7,108,031 B1 * 9/2006 Secrest ..... 144/358
7,137,229 B2 * 11/2006 Pervan ..... 52/313
7,152,383 B1 * 12/2006 Wilkinson et al. ..... 52/581
7,188,456 B2 * 3/2007 Knauseder ..... 52/592.1
7,219,392 B2 * 5/2007 Mullet et al. ..... 16/96 R
7,251,916 B2 * 8/2007 Konzelmann et al. ..... 52/592.1
7,257,926 B1 * 8/2007 Kirby et al. ..... 52/126.5
7,337,588 B1 * 3/2008 Moebus ..... 52/592.4
7,377,081 B2 * 5/2008 Ruhdorfer ..... 52/588.1
7,451,578 B2 * 11/2008 Hannig ..... 52/586.1
7,454,875 B2 * 11/2008 Pervan et al. ..... 52/586.2
7,516,588 B2 * 4/2009 Pervan ..... 52/592.1
7,533,500 B2 * 5/2009 Morton et al. ..... 52/177
7,556,849 B2 * 7/2009 Thompson et al. ..... 428/36.9
7,568,322 B2 * 8/2009 Pervan ..... 52/792.11
7,584,583 B2 * 9/2009 Bergelin et al. ..... 52/588.1
7,614,197 B2 * 11/2009 Nelson ..... 52/582.1
7,617,651 B2 * 11/2009 Grafenauer ..... 52/592.1
7,621,092 B2 * 11/2009 Groeke et al. ..... 52/586.1
7,634,884 B2 * 12/2009 Pervan et al. ..... 52/582.1
7,637,068 B2 * 12/2009 Pervan ..... 52/592.1
7,654,055 B2 * 2/2010 Ricker ..... 52/592.1
7,716,889 B2 * 5/2010 Pervan ..... 52/392
7,721,503 B2 * 5/2010 Pervan et al. ..... 52/586.1
7,726,088 B2 * 6/2010 Muehlebach ..... 52/582.1
7,806,624 B2 * 10/2010 McLean et al. ..... 404/47
7,841,145 B2 * 11/2010 Pervan et al. ..... 52/395
7,908,815 B2 * 3/2011 Pervan et al. ..... 52/582.1
7,980,039 B2 * 7/2011 Groeke et al. ..... 52/582.2
8,033,074 B2 * 10/2011 Pervan et al. ..... 52/582.1
8,042,311 B2 * 10/2011 Pervan et al. ..... 52/586.1
8,061,104 B2 * 11/2011 Pervan ..... 52/592.1
8,099,924 B2 1/2012 Braun
8,112,967 B2 * 2/2012 Pervan et al. ..... 52/747.11
8,181,416 B2 * 5/2012 Pervan et al. ..... 52/586.2
8,234,830 B2 * 8/2012 Pervan et al. ..... 52/588.1
8,302,361 B2 11/2012 Braun et al.
8,302,367 B2 * 11/2012 Schulte ..... 52/747.11
8,336,272 B2 * 12/2012 Prager et al. ..... 52/588.1
8,353,140 B2 * 1/2013 Pervan et al. ..... 52/588.1
8,448,402 B2 * 5/2013 Pervan et al. ..... 52/582.1
8,511,040 B2 8/2013 Braun et al.

(56) References Cited

U.S. PATENT DOCUMENTS

| | | | | |
|---|---|---|---|---|
| 8,596,013 | B2 | 12/2013 | Boo | |
| 2005/0028474 | A1* | 2/2005 | Kim | 52/578 |
| 2005/0050827 | A1* | 3/2005 | Schitter | 52/578 |
| 2006/0156670 | A1* | 7/2006 | Knauseder | 52/578 |
| 2008/0216920 | A1* | 9/2008 | Pervan | 144/363 |
| 2009/0019806 | A1* | 1/2009 | Muehlebach | 52/588.1 |
| 2010/0173122 | A1* | 7/2010 | Susnjara | 428/119 |
| 2010/0218450 | A1 | 9/2010 | Braun et al. | |
| 2010/0300029 | A1 | 12/2010 | Braun et al. | |
| 2011/0258959 | A1 | 10/2011 | Braun | |
| 2012/0067461 | A1 | 3/2012 | Braun | |
| 2012/0096801 | A1 | 4/2012 | Cappelle | |
| 2012/0174521 | A1 | 7/2012 | Schulte | |
| 2012/0192521 | A1* | 8/2012 | Schulte | 52/588.1 |
| 2013/0036695 | A1 | 2/2013 | Durnberger | |
| 2013/0047536 | A1* | 2/2013 | Pervan | 52/309.1 |
| 2013/0055950 | A1* | 3/2013 | Pervan et al. | 118/72 |
| 2013/0160390 | A1 | 6/2013 | Stockl | |
| 2013/0192158 | A1 | 8/2013 | Cappelle et al. | |
| 2013/0263454 | A1 | 10/2013 | Boo et al. | |
| 2013/0263547 | A1 | 10/2013 | Boo | |
| 2013/0276398 | A1 | 10/2013 | Hannig | |
| 2014/0059966 | A1 | 3/2014 | Boo | |

FOREIGN PATENT DOCUMENTS

| | | | |
|---|---|---|---|
| EP | 1 350 904 | A2 | 10/2003 |
| EP | 1 350 904 | A3 | 10/2003 |
| EP | 1 980 683 | A2 | 10/2008 |
| EP | 2 226 447 | A1 | 9/2010 |
| WO | WO 2006/043893 | A1 | 4/2006 |
| WO | WO 2007/015669 | A2 | 2/2007 |
| WO | WO 2008/004960 | A2 | 1/2008 |
| WO | WO 2008/004960 | A8 | 1/2008 |
| WO | WO 2008/116623 | A1 | 10/2008 |
| WO | WO 2009/033623 | A1 | 3/2009 |
| WO | WO 2009/116926 | A1 | 9/2009 |
| WO | WO 2010/081532 | A1 | 7/2010 |
| WO | WO 2010/142671 | A1 | 12/2010 |
| WO | WO 2011/001326 | A2 | 1/2011 |
| WO | WO 2011/032540 | A2 | 3/2011 |
| WO | WO 2011/117179 | A1 | 9/2011 |
| WO | WO 2012/084604 | A1 | 6/2012 |

* cited by examiner

BUILDING PANEL WITH A MECHANICAL LOCKING SYSTEM

CROSS REFERENCE TO RELATED APPLICATIONS

The present application is a continuation of U.S. application Ser. No. 14/074,273, filed on Nov. 7, 2013, which is a continuation of U.S. application Ser. No. 13/855,966, filed on Apr. 3, 2013, now U.S. Pat. No. 8,596,013, which claims the benefit of U.S. Provisional Application No. 61/620,233, filed on Apr. 4, 2012. The entire contents of U.S. application Ser. No. 14/074,273, U.S. application Ser. No. 13/855,966 and U.S. Provisional Application No. 61/620,233 are hereby incorporated herein by reference in their entirety.

FIELD OF THE INVENTION

The present disclosure relates to a building panel such as a floor panel, a wall panel, a ceiling panel, a furniture component or the like, which is provided with a mechanical locking system, and a method for producing said building panel with said locking system.

TECHNICAL BACKGROUND

Building panels provided with a mechanical locking system comprising a displaceable and resilient tongue cooperating with a tongue groove for vertical locking is known and disclosed in, e.g., WO 2006/043893. The tongue is a separate part and is made of e.g. plastic and inserted in a displacement groove at an edge of a panel. The tongue is pushed into the displacement groove during a vertical assembling of the panels and springs back into the tongue groove of an adjacent panel when the panels have reached a locked position.

Also known is a locking system for panels comprising a tongue, which is displaceable along the edge of a panel, see, e.g., WO 2009/116926, and cooperates with a tongue groove for vertical locking. The tongue is a separate part and is provided with several protrusions, which initially match recesses of the tongue groove. The panels may be assembled by a vertical movement and the tongue is displaced to a position in which the protrusions no longer match the recesses in order to obtain the vertical locking.

Although the description relates to floor panel, the description of techniques and problems thereof is applicable also for other applications, such as panels for other purposes, for example wall panels, ceiling panels, furniture etc.

A drawback with the known system is that a separate tongue must be produced and special inserting machines are required to position the tongue in the displacement groove with high precision.

The above description of various known aspects is the applicant's characterization of such, and is not an admission that any of the above description is considered as prior art.

SUMMARY

It is an object of certain embodiments of the present disclosure to provide an improvement over the above described techniques and known art.

A further object is to provide a locking system with a flexible and displaceable tongue that may be formed out of the edge of the building panel. Such a system may simplify the production since no loose and additional part is necessary to produce and position at the correct position in the locking system.

Another object is to provide a more efficient production method and which requires less complicated production equipment.

At least some of these and other objects and advantages that will be apparent from the description have been achieved by building panels provided with a mechanical locking system comprising a tongue, at an edge of a first panel, cooperating with a tongue groove, at an edge of an adjacent second panel, for vertical locking of the building panels. The edge of the first panel may be provided with a displacement groove, which is downwardly open, and comprises an inner wall, an outer wall, and an upper wall. The tongue may be formed out of the edge of the first panel. A displaceable part of the tongue may be displaceable into the displacement groove and the upper wall may be vertically positioned at an upper surface of the displaceable part of the tongue.

The length of the displacement groove, along the edge of the first panel, is preferably smaller than the length of the edge of the first panel. The length of the displacement groove is preferably in the range of about 10% to about 90% of the length of the edge of the first panel The resilient and displaceable part of the tongue makes it possible to assemble the first and the second panel by displacing the edges vertically in relation to each other. A part of the edge of the second panel may push the displaceable part of the tongue into the displacement groove. The resilient and displaceable part of the tongue is preferably configured to be displaced into the displacement groove by a lower lip of the tongue groove during assembling of the first and the second panel. The displaceable part of the tongue may spring at least partly back, when the first and the second panel are positioned in a locked position, and into the tongue groove of the second panel. The part of the edge and the displaceable tongue part are preferably configured such that the displaceable part is pushed in an essentially horizontal direction. An essentially horizontal displacement may decrease the risk that the displaceable part of the tongue gets stuck in the displacement groove.

The upper wall may cooperate, for guiding the displaceable part of the tongue and/or for the vertical locking, with the upper surface.

The upper wall may be positioned somewhat above the upper surface of the displaceable part, but a position at an essential equal level, may make the locking system more stable and stronger.

The displacement groove may be arranged in relation to the edge of the first panel so that a thin wall or sidewardly open groove is created, at the outer wall of the displacement groove, above and/or below the displaceable part of the tongue.

The thickness of the outer wall of the displacement groove at a first and upper part of the displacement groove, at the upper surface of the tongue, is preferably configured such that the outer wall at the first and upper part breaks during said assembling of the building panels when the displaceable part of the tongue is pushed into the displacement groove.

The thickness of the outer wall of the displacement groove at a second part of the displacement groove, below the displaceable part of the tongue, is preferably configured such that such that the outer wall at second part breaks during said assembling of the building panels when the displaceable part of the tongue is pushed into the displacement groove.

The outer wall at the first and upper part of the displacement groove and/or the outer wall of the displacement groove at the second part of the displacement groove may also be broken by a tool, preferably a rotating wheel, before assembling. An alternative for breaking is to make a cut by a tool, e.g., a knife or preferably a rotating knife.

The displacement groove may also be sidewardly open at the first and/or second part of the displacement groove.

A wall that breaks may provide overlapping surfaces between the displacement groove and the displaceable part when the displaceable part is not pushed into the displacement groove. The overlapping surfaces make the locking system more stable and stronger.

A sidewardly open displacement groove makes it easier to push the displaceable part of the tongue into the displacement groove.

The broken outer wall of the displacement groove may cooperate, for guiding the displaceable part of the tongue and/or for the vertical locking, with the displaceable part of the tongue.

The tongue may comprise a fixed part at each side of the displaceable part of the tongue.

The tongue groove may comprise recesses, which match the fixed part of the tongue.

The recesses may be in a lower lip of the tongue groove. The length, along the edge of the second panel, of the lower lip between the recesses is preferably smaller than the length displacement groove.

A contact surface of the lower lip of the tongue groove may cooperate, for the vertical locking, with a lower surface of the displaceable part of the tongue.

The contact surface may be positioned such that when the displaceable part of the tongue springs back, during assembling of the building panels, the displaceable part is prevented to reach its original position. The lower surface of the displaceable part tongue may assert a force against the contact surface of lower lip in order to avoid a play between the panels.

The tongue may have several displaceable parts and the edge of the first panel may be provided with several displacement grooves.

The locking system may comprise a locking element, preferably arranged on a locking strip, at the edge of the first or the second panel, which cooperates with a locking groove at the edge of the other of the first or the second panel, for locking the panels horizontally.

The first and the second panel are preferably essential equal, thus an edge opposite said edge of the first panel is provided with the same parts of the locking system as said edge of the second panel.

The panels may be square-shaped and the edges between the said edge and said opposite edge are preferably provided with a locking system which enables assembling to an adjacent panel by an angling movement.

The displacement groove may be filled with a resilient material, such as plastic or rubber, to improve the resilient properties of the displaceable part and/or to make the locking system stronger.

The building panel may be a floor panel, a wall panel, a ceiling panel, a furniture component or the like.

The core of the building panels may be a wood-based core, preferably made of MDF, HDF, OSB, WPC, or particleboard or of plastic e.g. vinyl or PVC.

The edge of the panels, of which the locking system may be made, may comprise the core material.

A second aspect of the disclosure are building panels provided with a mechanical locking system comprising a tongue, at an edge of a first panel, cooperating with a tongue groove, at an edge of an adjacent second panel, for vertical locking of the building panels. The edge of the first panel may be provided with a displacement groove to obtain a resilient and displaceable tongue part. Said displacement groove may be downwardly open, and comprises an inner wall, an outer wall and an upper wall. The tongue may be formed out of the edge of the first panel. The resilient and displaceable part of the tongue may be configured to be displaced partly into the displacement groove by a lower lip of the tongue groove during assembling of the first and the second panel by a vertical displacement of the second panel toward the first panel.

The thickness of the outer wall of the displacement groove at a first and upper part of the displacement groove, above the upper surface of the tongue, is configured such that the resilient and displaceable tongue part is obtained. Also the thickness of the outer wall of the displacement groove at a second part of the displacement groove, below the resilient and displaceable part of the tongue, is configured such that the resilient and displaceable tongue part is obtained. The outer wall at the first and upper part and at the second part is not, according to certain embodiments of the second aspect, intended to break. The purpose of the displacement groove and the outer wall at the first and upper part and at the second part is to make the resilient and displaceable tongue part more resilient and to provide an improved locking strength.

The tongue may comprise fixed parts at the side of the resilient and displaceable part of the tongue.

The tongue groove may comprise recesses, which match the fixed part of the tongue.

A contact surface of a lower lip of the tongue groove may cooperate, for the vertical locking, with a lower surface of the resilient and displaceable part of the tongue.

The contact surface may be arranged such that when the displaceable part of the tongue springs back, during the assembling of the building panels, the displaceable part is prevented from reaching its original position.

The tongue may have several displaceable parts and the edge of the first panel may be provided with several displacement grooves.

Also parts of the lower lip of the tongue groove may be made flexible and resilient. This may be achieved by providing a displacement groove also at the edge of the second panel.

The building panel may be a floor panel, a wall panel, a ceiling panel, a furniture component or the like.

The core of the building panels may be a wood-based core, preferably made of MDF, HDF, OSB, WPC, or particleboard or of plastic e.g. vinyl or PVC.

The edge of the panels, of which the locking system may be made, may comprise the core material.

A third aspect of the disclosure is a method to produce a building panel according to embodiments of the first or second aspect. The method may comprise the steps of:

- forming the tongue at the edge of the first panel.
- forming the displacement groove at the underside of the first panel, preferably by milling, sawing and/or drilling.
- milling the tongue groove at the opposite edge of said edge of the first panel.
- forming the recesses in the lower lip of the tongue groove, preferably by milling, sawing and/or drilling.

BRIEF DESCRIPTION OF THE DRAWINGS

The present disclosure will by way of example be described in more detail with reference to the appended schematic drawings, which shows embodiments of the present disclosure.

DETAILED DESCRIPTION

Figure 1:
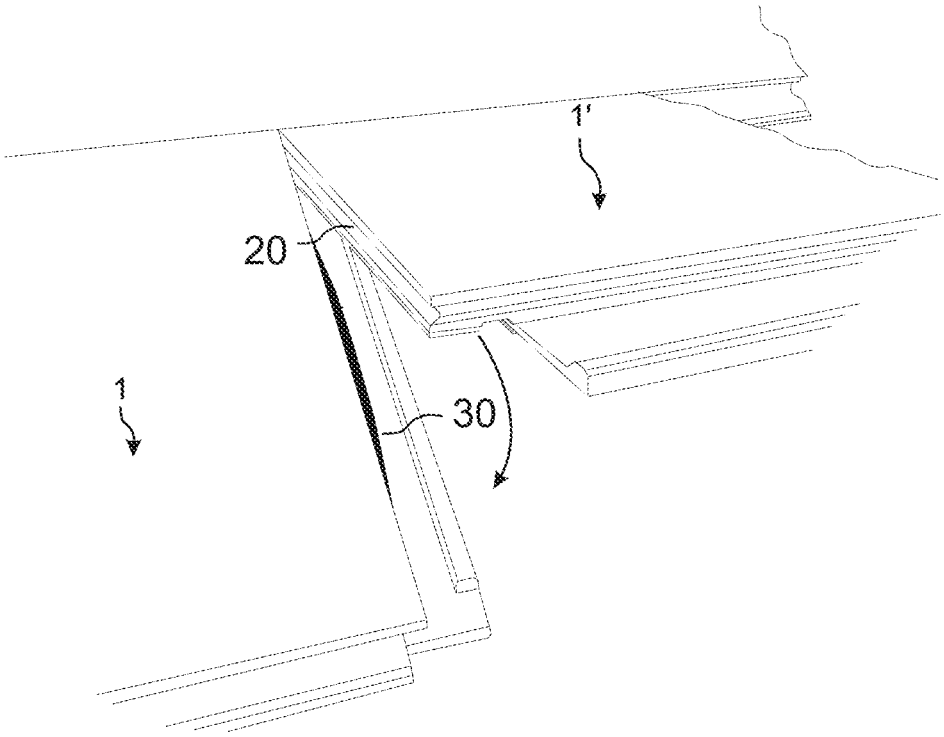
FIG. 1 shows a known locking system with a separate and resilient tongue.

A known locking system for building panels, which comprises a displaceable and resilient tongue 30 cooperating with a tongue groove 20 for vertical locking of the short edges is shown in FIG. 1. The tongue 30 is a separate part and is made of, e.g., plastic, and inserted in a displacement groove at a first short edge of a panel. The tongue is pushed into a displacement groove during a vertical assembling of the short edges of the panels and springs back into a tongue groove at a second short edge of an adjacent panel when the panels have reached a locked position. The long edges of the panels are provided with a locking system, which enables assembling to an adjacent panel by an angling movement, to obtain a simultaneous assembling of adjacent long and short edges.

Figure 2A:
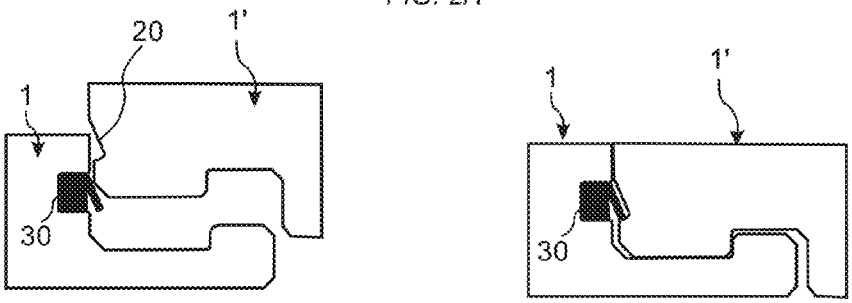
FIGS. 2A-C shows a cross section of a known locking system with a separate and displaceable tongue.
Figure 2B:
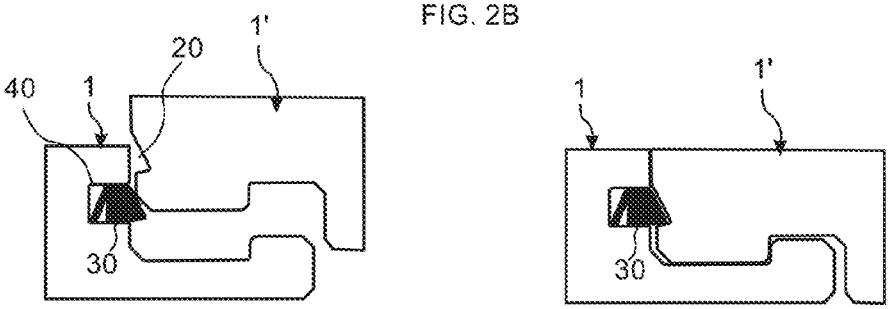
Figure 2C:
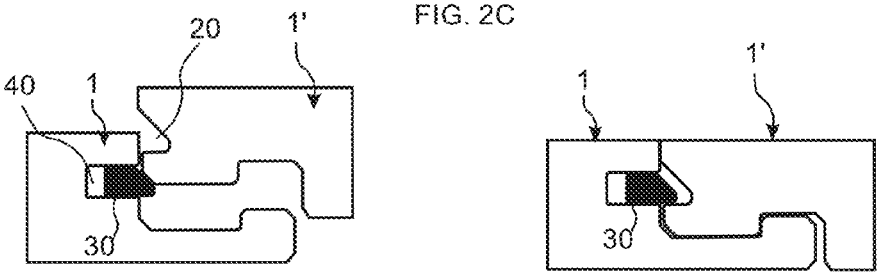

FIGS. 2*a-b* show cross sections of different embodiments of the known displaceable and resilient tongue 30 during assembling of two adjacent short edges. The panel with the tongue groove is lowered in relation to the panel with tongue 30, which is pushed into the displacement groove by the lowered panel. The tongue springs back, and into the tongue groove, when the panels has reached an assembled position, and locks the panels vertically.

Figure 3:
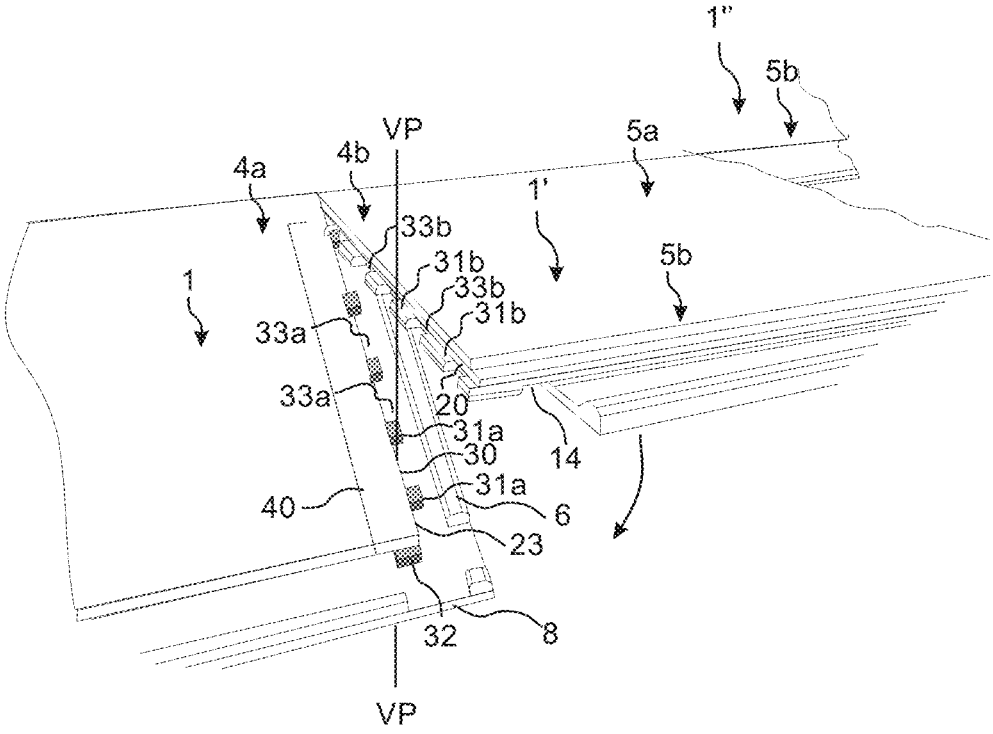
FIG. 3 shows a known locking system with a separate and displaceable tongue.

A known locking system for panels comprising a tongue 30, which is displaceable along the short edge 4*a* of a panel 1 in a displacement groove 40 and cooperates with a tongue groove 20 for vertical locking of adjacent short edges 4*a*, 4*b* is disclosed in FIG. 3. The tongue is a separate part and is provided with several protrusions 31*a*, which initially match recesses 33*b* of the tongue groove 20. The panels 1, 1' may be assembled by a vertical movement and the tongue is displaced, by applying a force at a part 32 of the tongue 30, to a position in which the protrusions no longer match the recesses in order to obtain the vertical locking. The long edges 5*a*, 5*b* of the panels are provided with a locking system, which enables assembling to an adjacent panel 1" by an angling movement, to obtain a simultaneous assembling of adjacent long 5*a*, 5*b* and short edges 4*a*, 4*b*.

Embodiments of the disclosure is shown in FIGS. 4, 5, 6*a-c*, 7*a-d*, 8*a-b* and 9*a-b*. A locking system is formed at adjacent edges of an adjacent first and second panel 1, 1' for locking the adjacent edges in a vertical and/or horizontal direction. An embodiment of the locking system enables assembling of panels at the adjacent edges by a vertical movement, see FIGS. 7*a-d*. The locking system is preferably formed by mechanical cutting, such as milling, drilling and/or sawing, of the edges of the panels.

A tongue 30 is formed at an edge of the first panel 1. The tongue 30 cooperates with a tongue groove 20, which is formed at an edge of an adjacent panel 1', for vertical locking of the panel 1, 1'. A locking strip 8 with a vertically protruding locking element is formed in the edge of the first panel. The locking element 6 cooperates with a locking groove 14, formed at the edge of the second panel 1', for horizontal locking of the panels 1, 1'.

A displacement groove 60 is formed in the edge of the first panel behind the tongue 30. The displacement groove 60 makes a part 66 of the tongue 30 displaceable. During assembling of the first and the second panel 1, 1' the displaceable part 66 is pushed into the displacement groove 60 by a lower lip 31 of the tongue groove 20. When the panels are in a locked position the displaceable part 66 springs back and into the tongue groove 20.

Other parts 68 of the tongue 30, beside the displacement groove 60 and the displaceable part 66 of the tongue 30, is fixed. To enable the panels 1, 1' to be assembled by a vertical movement, recesses 69 are formed in a lower lip 31 of the tongue groove 20. The recesses 69 match the fixed parts 68 of the tongue.

Figure 4:
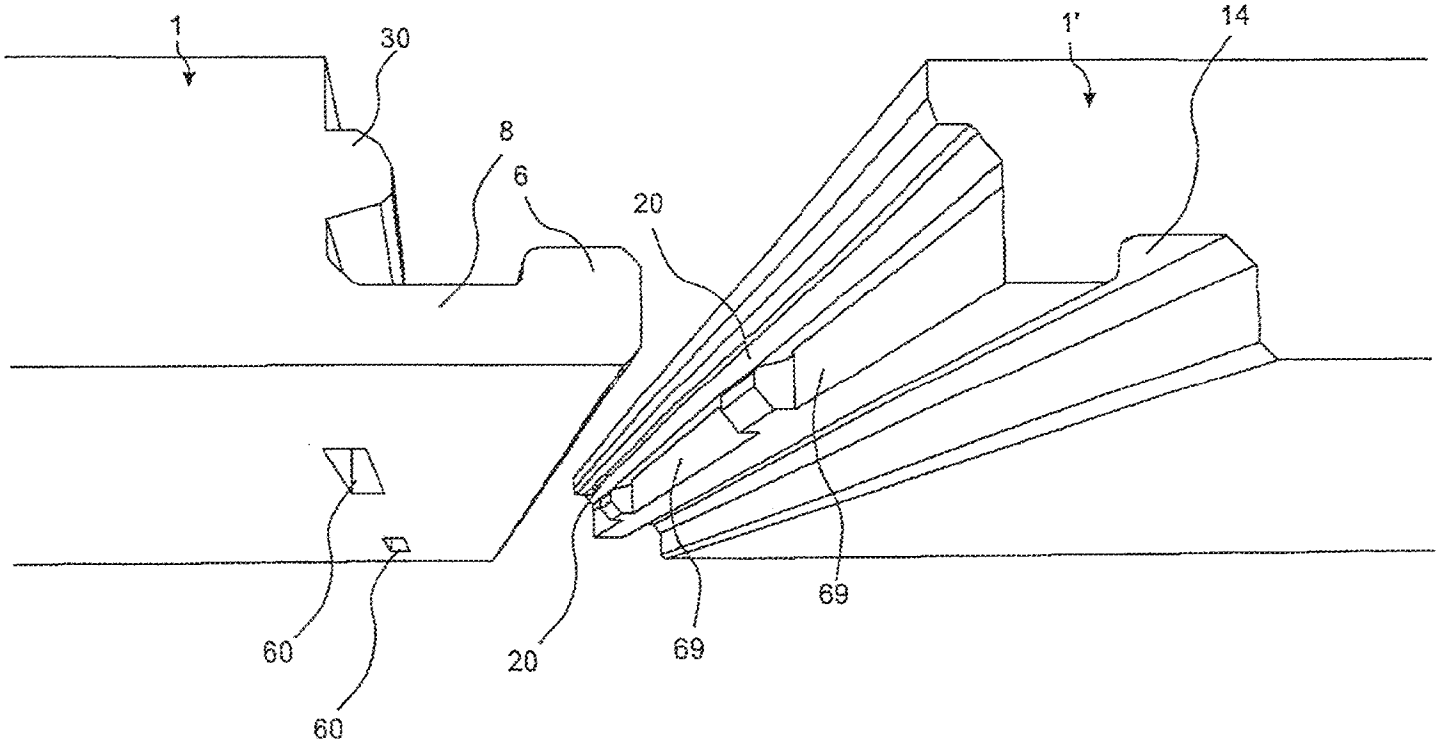
FIG. 4 shows a 3D view of building panels according to an embodiment of the disclosure.
Figure 5:
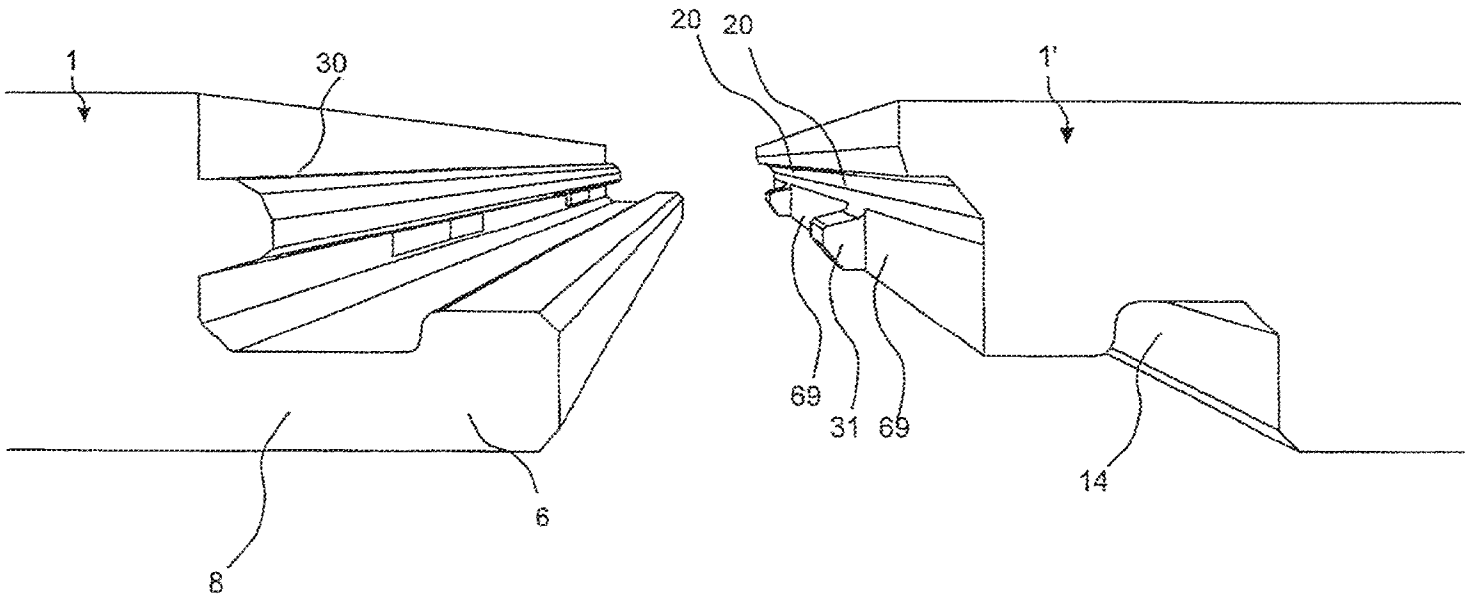
FIG. 5 shows a 3D view of building panels according to an embodiment of the disclosure.
Figure 6A:
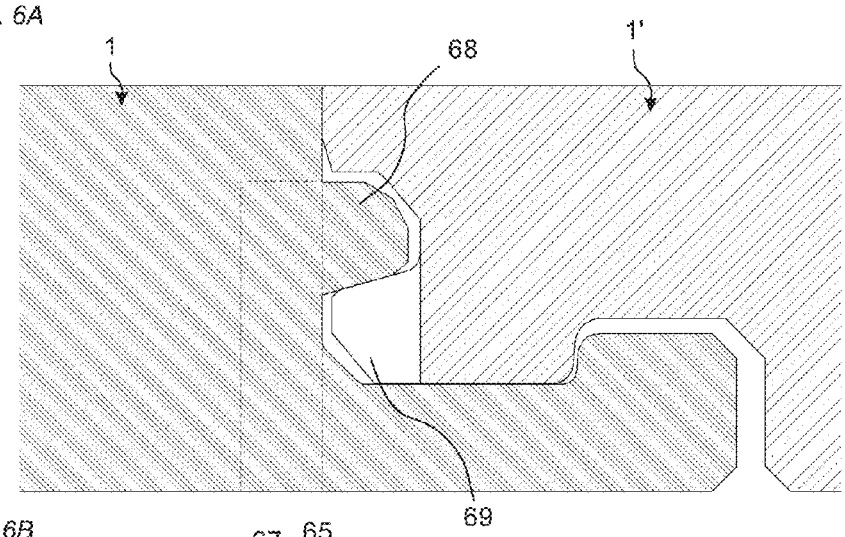
FIGS. 6A-B show cross sections of building panels according to an embodiment of the disclosure.
Figure 6B:
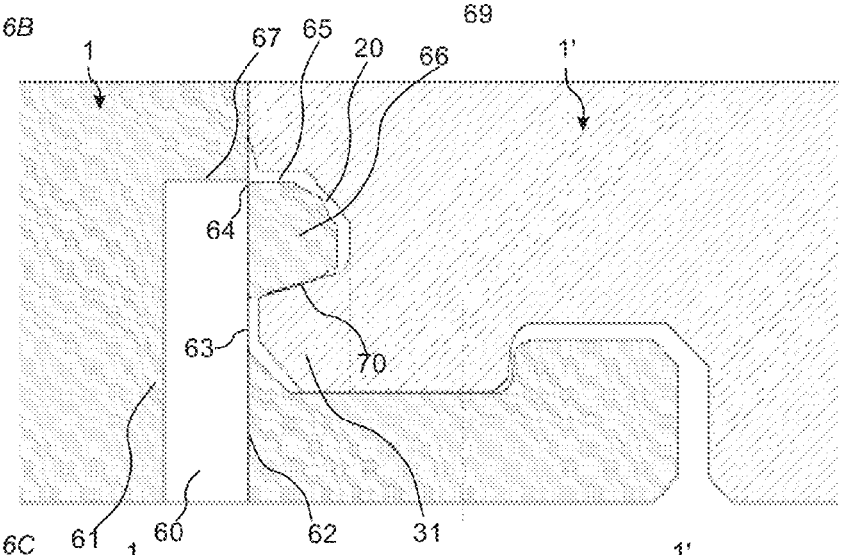

FIGS. 4, 5, 6*a-c*, 7*a-d* and 8*b* show a first embodiment comprising a tongue 30 with two displaceable parts 66 and three fixed parts 68, two displacement grooves 60, and a lower lip 31 of a tongue groove 20 with three recesses 69. The cross section in FIG. 6*a* is at the D-D line indicated in FIG. 8*a* and the cross section in FIG. 6*b* is at the C-C line indicated in FIG. 8*a*.

Figure 8A:
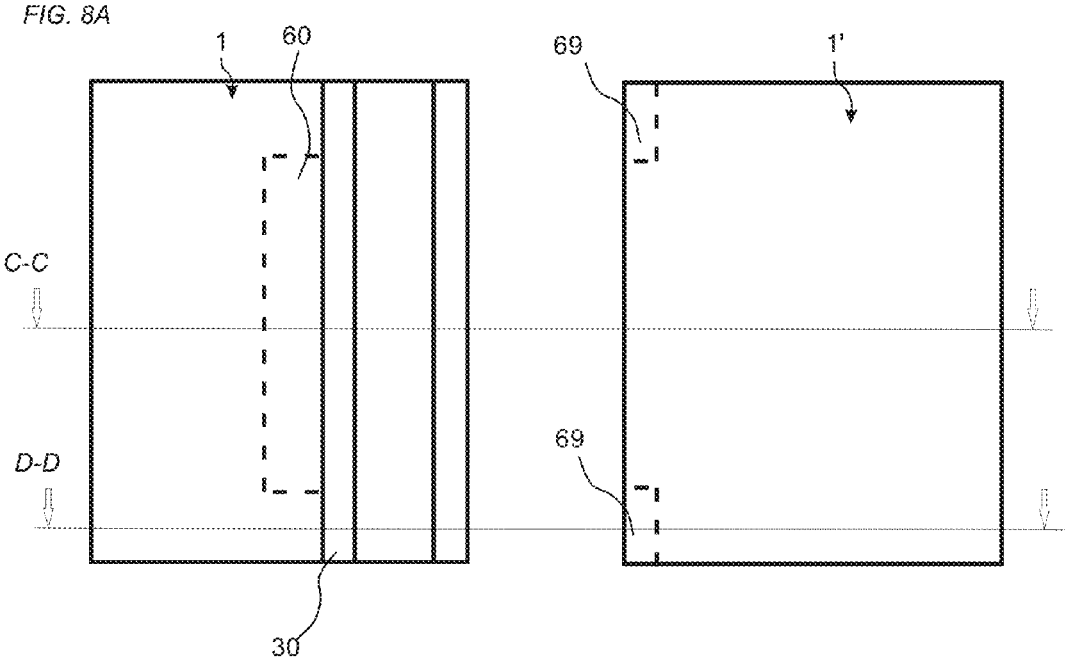
FIGS. 8A-B show top views of the building panels according to embodiments of the disclosure.
Figure 8B:
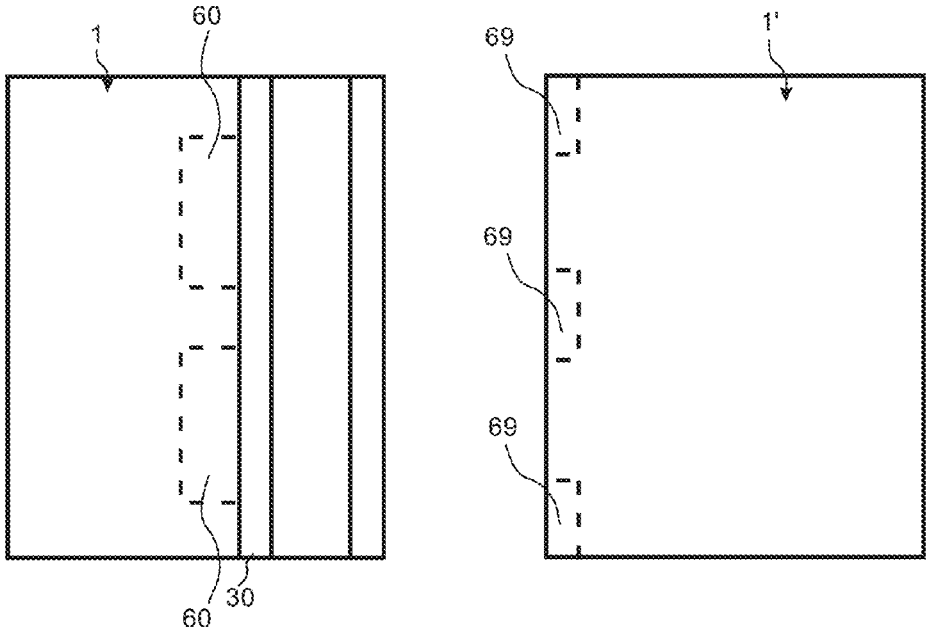

FIG. 8*a* shows a second embodiment comprising a tongue 30 with one displaceable part 66 and two fixed parts 68, one displacement groove 60, and a lower lip of the tongue groove 20 with two recesses 69.

The first embodiment is shown in a 3D view in FIGS. 4 and 5.

Figure 6C:
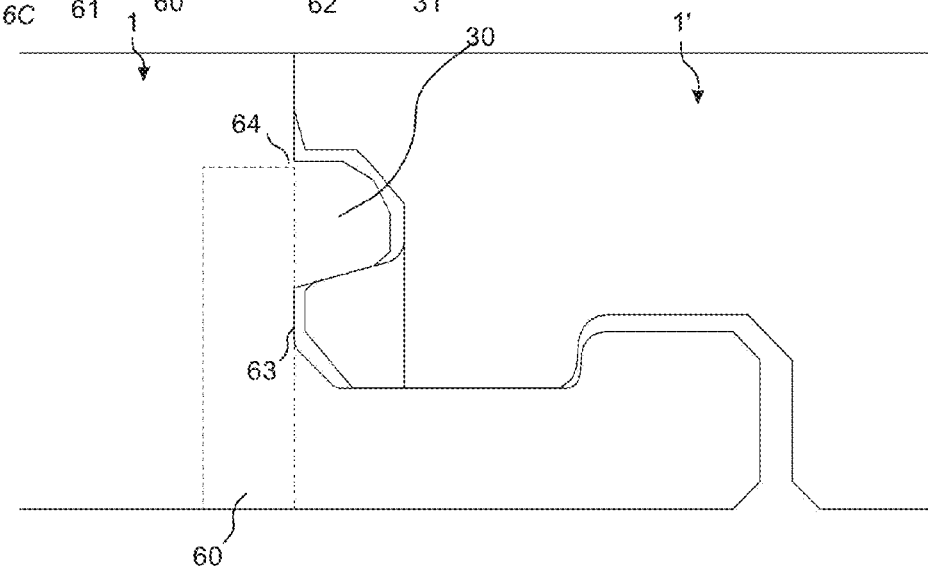
FIG. 6C shows a side view of building panels according to an embodiment of the disclosure.
Figure 7A:
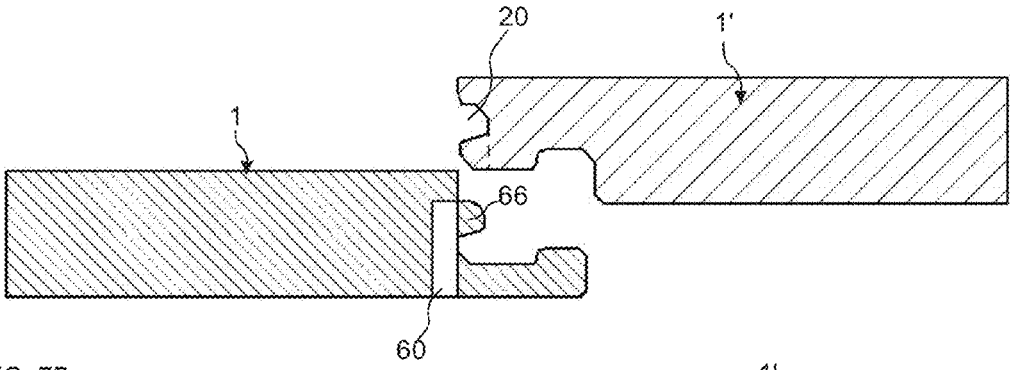
FIGS. 7A-D shows an embodiment of assembling according to an embodiment of the disclosure.
Figure 7B:
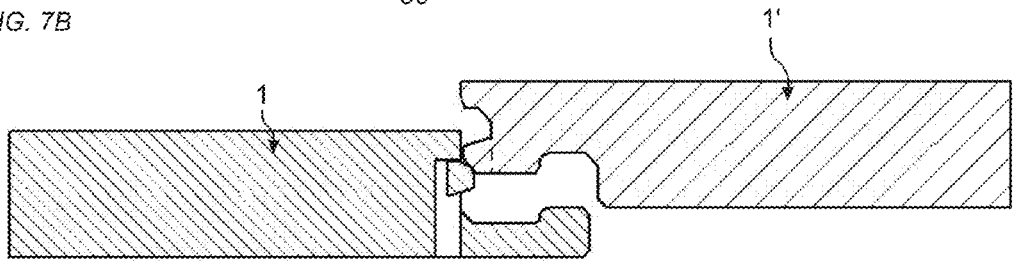
Figure 7C:
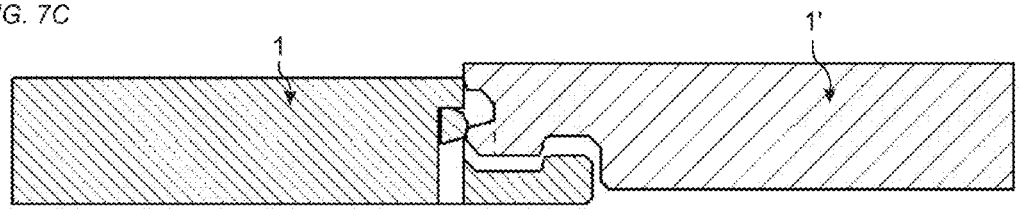
Figure 7D:
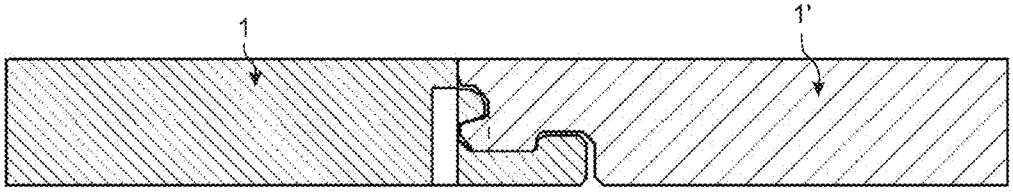

The cross sections in FIGS. 6*a* and *b* and the side view in FIG. 6*c*, show that a lower surface of the displaceable part 66 cooperates, for vertical locking of adjacent edges of the panels 1,1', with a contact surface 70 of the lower lip 31 of the tongue groove 20. A vertical movement of the displaceable part is restrained, since the displaceable part of the tongue is continuous with the fixed part 68 of the tongue 30*a*.

The displacement groove 60 is formed from the underside of the first panel 1' and comprises an inner wall 61, an outer wall 62, and an upper wall 67. The displacement groove 60 may be positioned, in relation to the edge of the first panel, such that the thickness of the outer wall at a first 64 and upper part of the displacement groove 60, at the upper surface 65 of the tongue 30, is configured such that the outer wall breaks during assembling of the building panels when the displaceable part 66 of the tongue is pushed into the displacement groove 60.

The displacement groove 60 may also be positioned, in relation to the edge of the first panel, such that the thickness of the outer wall of the displacement groove 60 at a second part 63 of the displacement groove 60, below the displaceable part 66 of the tongue 30, is configured such that outer wall breaks during assembling of the building panels when the displaceable part 66 of the tongue is pushed into the displacement groove 60.

The walls at the at the first 64 and upper part of the displacement groove 60 and/or the second part 63 of the displacement groove 60 may also be broken before assembling of the building panels by pushing the displaceable part 66 of the tongue 30 into the displacement groove by a tool, such as a rotating wheel. An alternative is to use a cutting tool, such as a rotating wheel to separate the displaceable part 66 from the walls.

The broken outer wall of the displacement groove may cooperate with the displaceable part of the tongue and thereby improve the guiding of the displaceable part 66 of the tongue 30 and/or improve the vertical locking.

If the displacement groove 60 is positioned, relation to the edge of the first panel, such that a sidewardly open groove is formed at the first and/or second part 64, 63 of the displacement groove, the force required to push the displaceable part 66 of the tongue 30 into the displacement groove 60 is lowered.

Figure 9A:
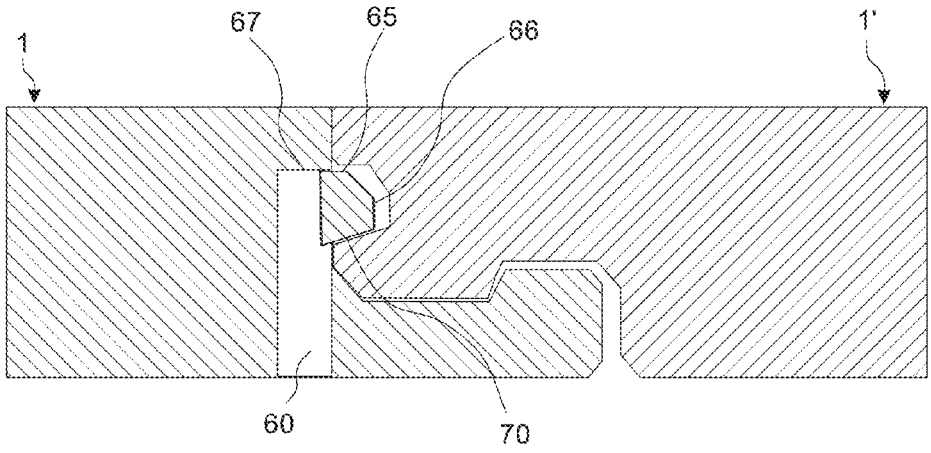
FIGS. 9A-B show a cross of the building panels according to embodiments of the disclosure.
Figure 9B:
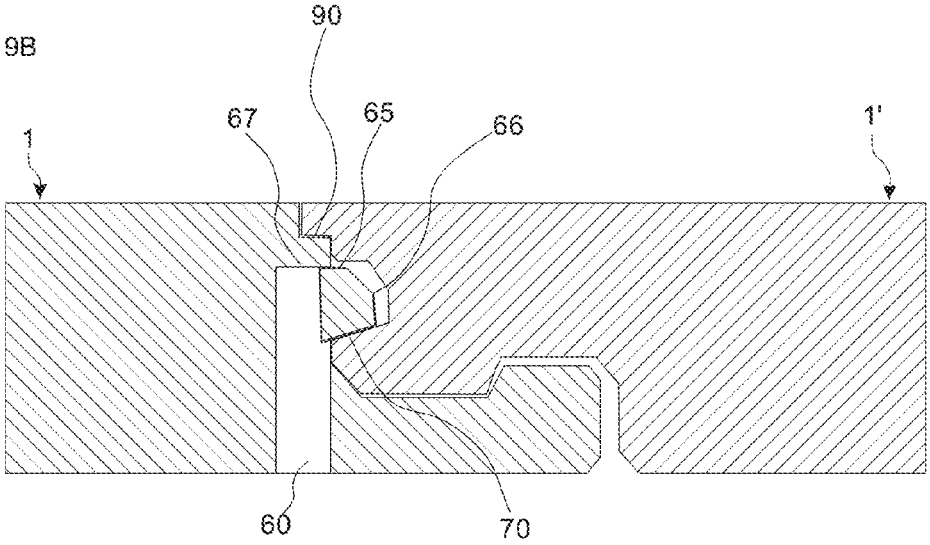

The contact surface 70 of the lower lip 31 may be positioned such that the displaceable part 66 of the tongue 30 is prevented to spring back to its initial position before assembling and thereby remains, in an assembled and locked position of the panels 1, 1', partly in the displacement groove 66. This position of the contact surface 70 result in that the lower surface of the displaceable part of the tongue asserts a force against the contact surface of lower lip in the locked position of the panels 1,1', which is shown in FIGS. 9*a* and 9*b*. The asserted force improves the locking and a play between the panels may be possibly avoided or reduced.

To decrease the force applied on the tongue when a load is applied on the building panels and to further improve the strength and tolerances of the locking system, the edges of the adjacent panels may be provided with upper overlapping surfaces 90, which are shown in FIG. 9*b*. The upper overlapping surfaces are preferably essentially horizontal.

If the tongue remains in the displacement groove 60 the upper wall 67 of the displacement groove 60 may cooperate, for an improved vertical locking of the adjacent edges of the first and second panels 1,1', with an upper surface 65 of the displaceable part 66 of the tongue 30.

In order to improve the spring properties of the displaceable part 66 of the tongue 30, the displacement groove 60 may be filled or provided with an elastic material such as plastic or rubber. The improved spring properties may result in an improved locking.

Figure 10A:
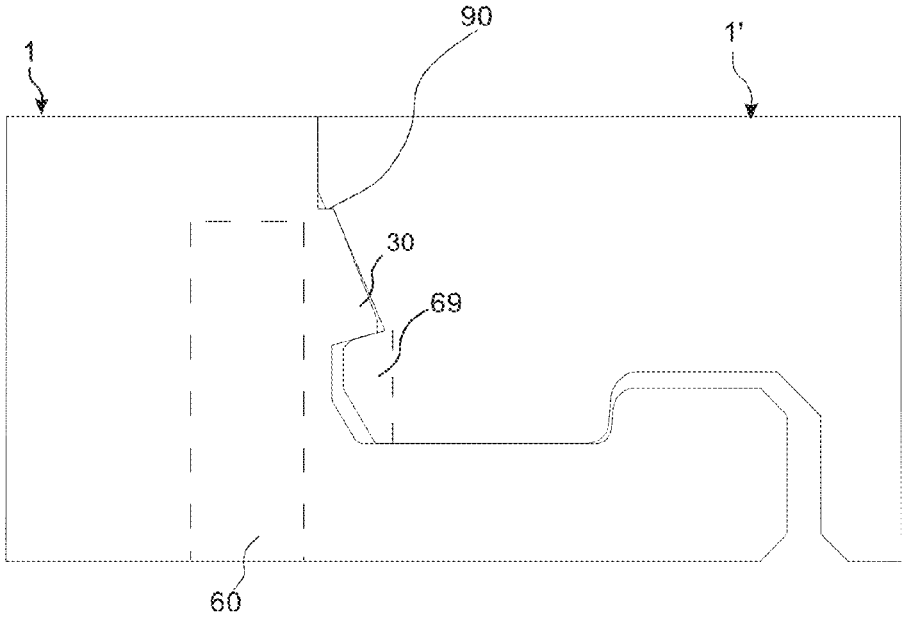
FIGS. 10A-B show a top view and a side view of the building panels according to an embodiment of the disclosure.
Figure 10B:
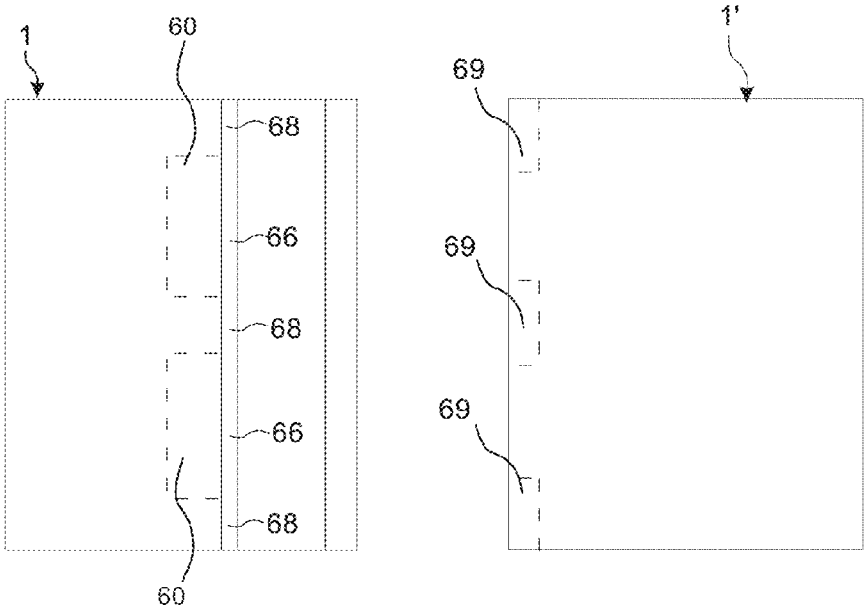
Figure 12A:
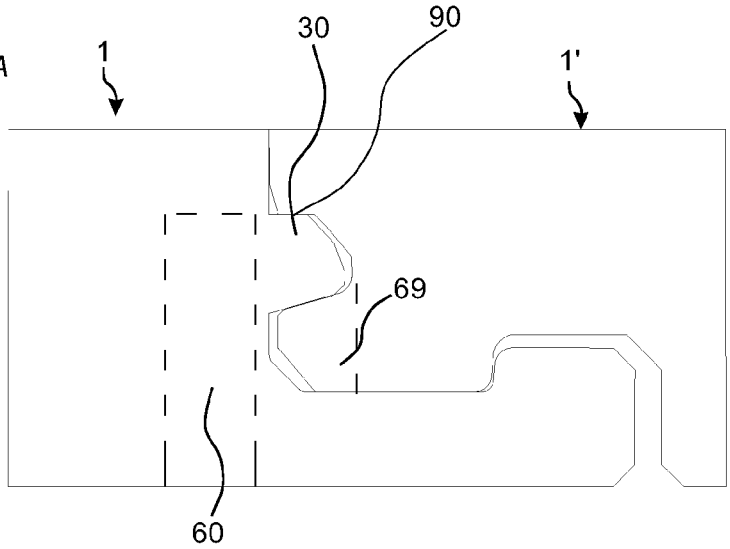
FIGS. 12A-C show a side view and two cross-sections of building panels according to an embodiments of the disclosure.

An embodiment comprising a displacement groove 60 with an outer wall, which is not intended to break during assembling, is shown in FIG. 10*a*. The side view in FIG. 10*a* shows that the distance from the edge of the first panel 1 is increased. The displacement groove has the result that a resilient and displaceable tongue part 66 is obtained. The top view in FIG. 10*b* shows an embodiment with an edge of a first panel 1 comprising two displacement grooves 60 and a tongue 30 with two resilient and displaceable parts 66 and three fixed parts 68 and an adjacent edge of a second panel 1' comprising a tongue groove with a lower lip provided with three recesses 69 that matches the fixed parts 68 of the tongue. The tongue comprises an upper essentially horizontal surface 90, which preferably extends along the whole edge. The upper essentially horizontal surface increases the strength of the locking system. FIG. 12*a* shows in a side view that the size of the tongue may be increased for building panels comprising favourably resilient material.

Figure 11A:
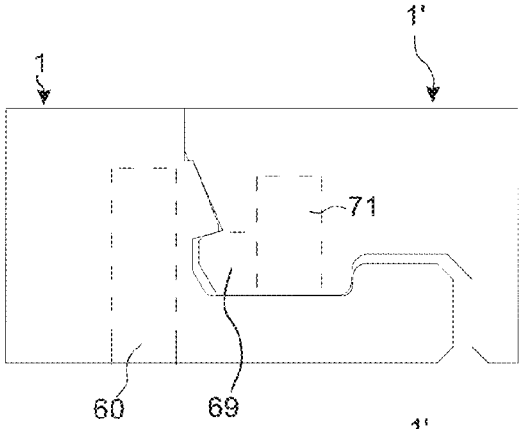
FIGS. 11A-D show a top view, a side view and two cross sections of building panels according to an embodiment of the disclosure.
Figure 11B:
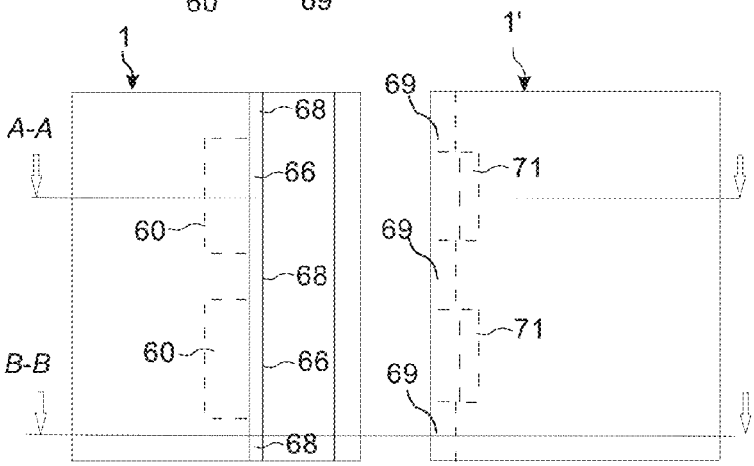
Figure 11C:
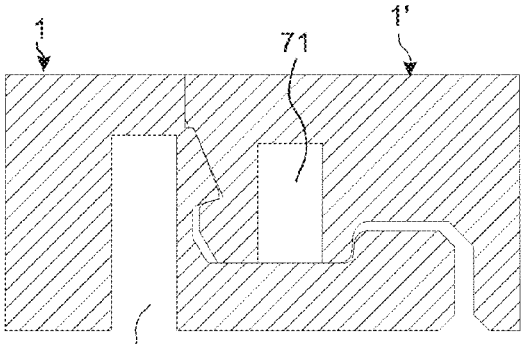
Figure 11D:
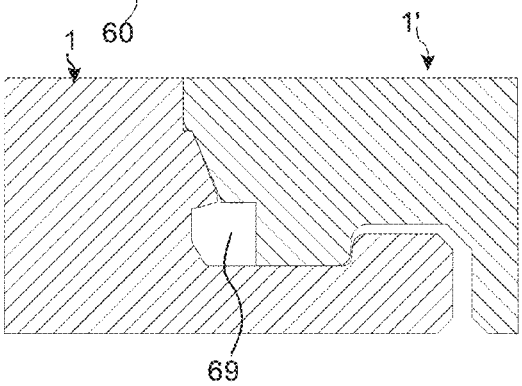

FIGS. 11*a-c* show an embodiment in which also parts of the lower lip of the tongue groove is made flexible and resilient. This is achieved by providing a displacement groove also at the edge of the second panel. The side view in FIG. 11*a* and the cross section 11*c* show an embodiment comprising a displacement groove 71 which downwardly open at a distance from the tongue groove. The cross section in FIG. 11*c* is indicated in the top view in FIG. 11*b* by the A-A line. The cross section in FIG. 11*d* is indicated in the top view in FIG. 11*b* by the B-B line. The top view in FIG. 11*b* shows an embodiment with an edge of a first panel 1 comprising two displacement grooves 60 and a tongue with two resilient and displaceable parts 66 and three fixed parts 68 at an edge of a first panel 1, and an adjacent edge of a second panel 1' comprising a tongue groove with a lower lip provided with three recesses 69 that correspond to fixed parts 68 of the tongue, and two displacement grooves 71, to obtain two flexible parts at the lower lip of the tongue groove.

Figure 12B:
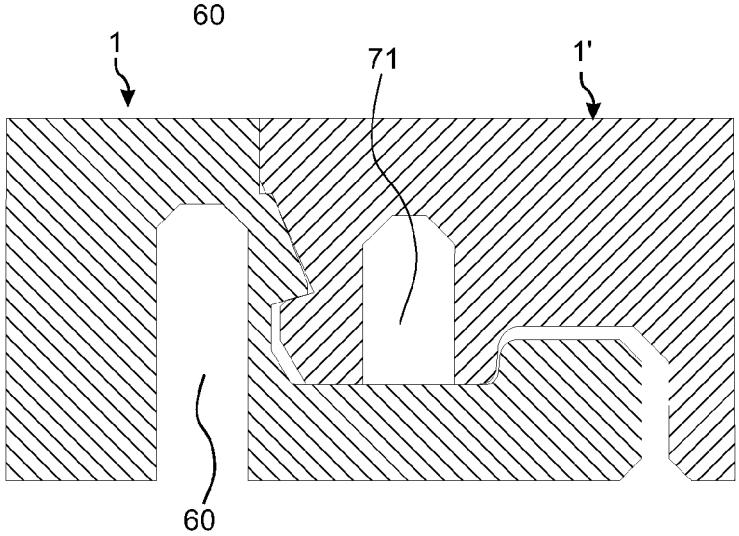
Figure 12C:
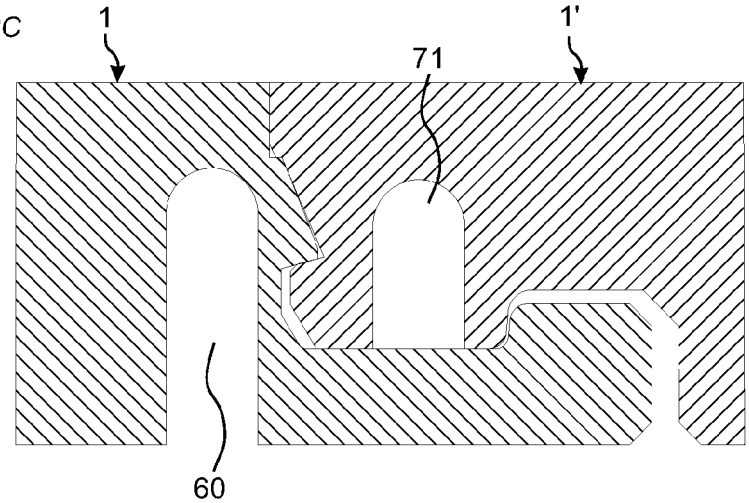

Alternative shapes of displacement grooves 60, 71 at the edge of the first and second panel 1, 1' are shown in FIGS. 12*b-c*. The upper wall of the displacement groove is of a rounded shape in order to increase the strength of the displacement groove.

The invention claimed is:

1. Building panels provided with a mechanical locking system comprising a tongue, at an edge of a first panel, cooperating with a tongue groove, at an edge of an adjacent second panel, for vertical locking of the building panels, wherein the edge of the first panel is provided with a displacement groove to obtain a resilient and displaceable part of the tongue, said displacement groove is downwardly open, and comprises an inner wall, an outer wall and an upper wall, the tongue is formed out of the edge of the first panel, the resilient and displaceable part of the tongue is configured to be displaced into the displacement groove by a lower lip of the tongue groove during assembling of the first and the second panel by a vertical displacement of the second panel toward the first panel, the thickness of the outer wall of the displacement groove at a first and upper part of the displacement groove, at the upper surface of the tongue, is configured such that the outer wall at the first and upper part breaks during said assembling, the thickness of the outer wall of the displacement groove at a second part of the displacement groove, below the resilient and displaceable part of the tongue, is configured such that the outer wall at the second part breaks during said assembling, and the edge of the first panel and the edge of the second panel are provided with upper overlapping surfaces.

2. The building panels as claimed in claim 1, wherein the upper overlapping surfaces are essentially horizontal.

3. The building panels as claimed in claim 1, wherein the upper overlapping surfaces extend along the entire length of the edge of the first panel and the edge of the second panel.

4. The building panels as claimed in claim 1, wherein the upper overlapping surfaces are positioned above the tongue.

5. The building panels as claimed in claim 1, wherein the upper wall is vertically positioned at an upper surface of the resilient and displaceable part of the tongue.

6. The building panels as claimed in claim 5, wherein the upper wall is configured to guide the resilient and displaceable part of the tongue.

7. The building panels as claimed in claim 5, wherein the upper wall is configured to cooperate with the upper surface of the resilient and displaceable part of the tongue for the vertical locking.

8. The building panels as claimed in claim 1, wherein the outer wall at least one of the first and upper part and the second part after breaking is configured to guide the resilient and displaceable part of the tongue during the assembling.

9. The building panels as claimed in claim 1, wherein the outer wall at least one of the first and upper part and the second part cooperate(s) with the resilient and displaceable part of the tongue for the vertical locking.

10. The building panels as claimed in claim 1, wherein the tongue comprises fixed parts at a side of the resilient and displaceable part of the tongue.

11. The building panels as claimed in claim 10, wherein the tongue groove comprises recesses, which correspond to the fixed parts of the tongue.

12. The building panels as claimed in claim 1, wherein a contact surface of the lower lip of the tongue groove cooperates, for the vertical locking, with a lower surface of the displaceable part of the tongue.

13. The building panels as claimed in claim 12, wherein the contact surface is arranged such that when the resilient and displaceable part of the tongue springs back, during the assembling of the building panels, the displaceable part is prevented from reaching its original position.

14. The building panels as claimed in claim 1, wherein the tongue has several displaceable parts and the edge of the first panel is provided with several displacement grooves.

15. The building panels as claimed in claim 1, wherein the resilient and displaceable part of the tongue includes an inner wall facing the displacement groove.

16. The building panels as claimed in claim 15, wherein the inner wall of the resilient and displaceable part of the tongue is displaced in an essentially horizontal direction by translation movement during the assembling.

17. The building panels as claimed in claim 1, wherein the thickness of the outer wall of the displacement groove at the second part of the displacement groove, below the resilient and displaceable part of the tongue, is configured such that the resilient and displaceable part of the tongue is obtained.

* * * * *